United States Patent [19]

Chadwick et al.

[11] Patent Number: 4,541,591

[45] Date of Patent: Sep. 17, 1985

[54] GUIDANCE LAW TO IMPROVE THE ACCURACY OF TACTICAL MISSILES

[75] Inventors: William R. Chadwick, Fredericksburg; Conrad M. Rose, Dahlgren, both of Va.

[73] Assignee: The United States of America as represented by the Secretary of the Navy, Washington, D.C.

[21] Appl. No.: 481,213

[22] Filed: Apr. 1, 1983

[51] Int. Cl.[4] ..... F41G 7/22

[52] U.S. Cl. ..... 244/3.15

[58] Field of Search ..... 244/3.15, 3.2, 3.21, 244/3.16

[56] References Cited

U.S. PATENT DOCUMENTS

| | | | |
|---|---|---|---|
| 3,206,143 | 9/1965 | Von Münchhofen | 244/3.15 |
| 3,905,563 | 9/1975 | Nagoshi | 244/3.15 |
| 4,189,116 | 2/1980 | Ehrich et al. | 244/3.16 |
| 4,231,533 | 11/1980 | Durig | 244/3.16 |
| 4,264,907 | 4/1981 | Durand, Jr. et al. | 244/3.15 |
| 4,288,050 | 9/1981 | Gauggel | 244/3.16 |

*Primary Examiner*—Charles T. Jordan

*Attorney, Agent, or Firm*—Robert F. Beers; Kenneth E. Walden; John C. Laprade

[57] ABSTRACT

A missile guidance system in a canard controlled airframe with means to measure the angle of attack as well as the pursuit angle by the use of a two degree of freedom roll-free reference gyroscope or other inertial reference device so as to move the canard control surfaces, where the canards direct the missile to the target.

10 Claims, 6 Drawing Figures

GUIDANCE LAW TO IMPROVE THE ACCURACY OF TACTICAL MISSILES

BACKGROUND OF THE INVENTION

At the present time proportional navigation is used to guide most tactical missiles to high speed maneuvering air targets. This technique has also been used against much slower surface targets, although in this latter case there are two good reasons for using pursuit guidance instead.

First, implementation of pursuit guidance using a velocity-vane or weathercock stablized seeker is very simple: certainly much simpler than any known implementation of proportional navigation. Second, in the presence of gravity pursuit guidance yields a straighter flight path to the target.

The velocity-vane implementation of pursuit guidance has been available a number of years in commercial guidance equipment sold by and marketed throughout the world by the Texas Instrument Company. This "Weathercock or Velocity-vane Seeker System" has been sold to as many as 50 countries and comprises generally speaking a statically stable seeker head on the front of a rotary pivoted member called a boom. The weathercock or velocity-vane contains a four-quadrant laser detector. By means of a laser beam scattered from the target the Texas Instrument weathercock seeker system would in effect guide a missile or bomb onto a stationary target on a still or windless day. It is well known in the art however that against a moving surface target, or in the presence of a crosswind, pursuit guidance as implemented by the weathercock system developed by the Texas Instrument Co. has fundamental limitations. Specfically, the bomb or missile will always miss the designated target under these conditions by distances typically as high as forty (40) feet.

SUMMARY OF THE INVENTION

The invention involves the use of a two-degree-of-freedom roll-free reference gyroscope, or other inertial reference device performing the same function, in combination with a velocity-vane seeker, the seeker modified from that currently commercially available to measure the angle of attack as well as the pursuit angle, the outputs from the inertial reference and seeker combined electronically or otherwise to form a control input to automatically move the canard control surfaces on a missile airframe, where the canards direct the missile to the target.

Accordingly, one object of the invention is to improve the accuracy of tactical missiles employing velocity-vane seekers against surface targets.

It is another object of the instant invention to provide a modification to the classical pursuit law heretofor employed with the velocity-vane or weathercock stablized seeker.

It is a still further object of the invention to implement the use of this modified pursuit guidance law by utilizing an inertial reference device, e.g. a two-degree-of-freedom roll-free gyroscope.

It is another important object of this invention to disclose a method of utilizing an inertial reference device and velocity-vane seeker to measure the missile flight path angle.

DETAILED DESCRIPTION OF THE INVENTION

Figure 1:
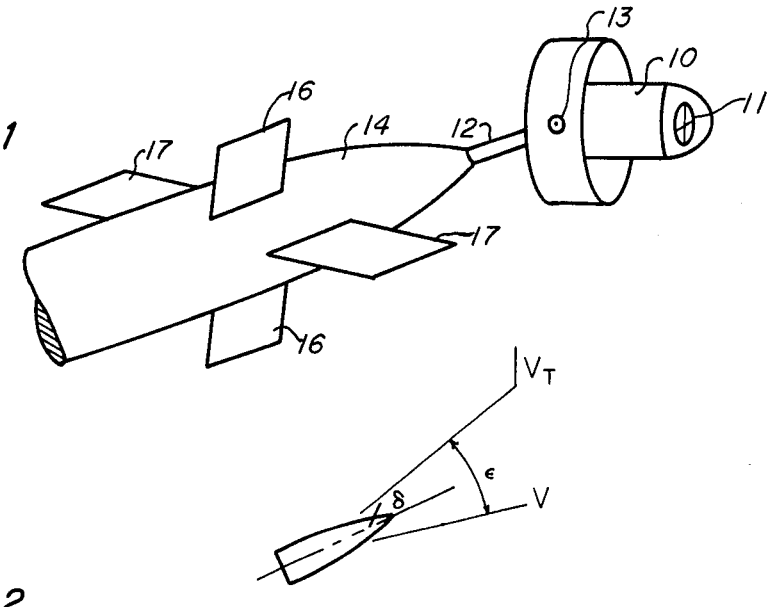
FIG. 1 is a perspective view of the prior art weathercock stablized seeker with detector.

FIG. 1 illustrates in cutaway perspective view the Texas Instrument prior art pursuit guidance system called a "weathercock or velocity-vane laser seeker guidance system." The invention described and claimed in the instant patent application is a modification of and an improvement of the Texas Instrument weathercock laser seeker guidance system.

Figure 3:
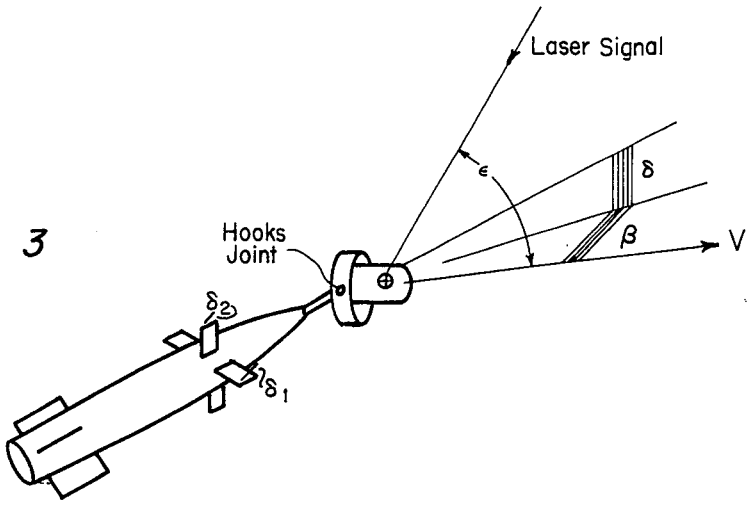
FIG. 3 is a perspective view of the use of the weather cock stabilized seeker to measure the missile angle of attack.

In FIG. 1 the velocity-vane seeker 10 is fastened to the nose of the missile 14 by a solid rod member 12 with a forward connection means known as a "hooks joint" 13. The hooks joint is a completely rotatable pivot means that is well known in mechanical design that allows the velocity-vane laser seeker to rotate and move in response to the airflow caused by the missiles' velocity. A cooled four quadrant laser detector 11, well known in the art, or any means capable of responding to energy reflected or emanating from a target, is located in the nose of the seeker. This device transmits a signal created by the incident energy into the nose of the guided missile 14 as has been done for many years by the Texas Instruments laser seeker system, sold on the market both in the U.S. and to approximately 50 foreign countries. A servomotor responding to electrical signals from the four guadrant detector, moves each of the canard pairs numbered 16 and 17 in FIG. 1. FIG. 3 indicates in some detail how the pursuit guidance system is implemented in two dimensions. Orthogonal components of the pursuit error angle epsilon ($\xi$) are measured in two "control planes"; canard deflections delta ($\delta_1$) and delta ($\delta_2$) proportional to these measurements then produce steady-state yaw angles alpha ($\alpha$) and beta ($\beta$) relative to missile velocity V which cause the missile to accelerate laterally in the direction of the target.

Figure 2:
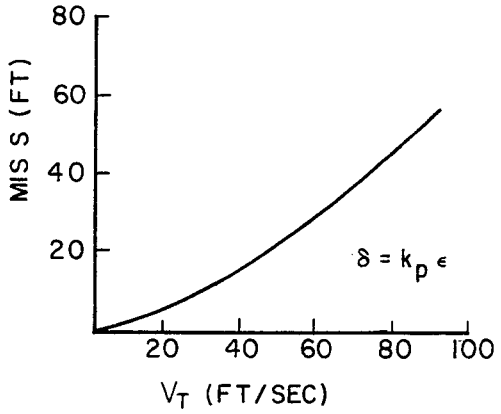
FIG. 2 is a two demensional representation of the classical pursuit guidance law with a graphic illustration of miss at intercept plotted against target velocity.

Against stationary targets, and with no appreciable crosswind or flow bias effect, the weathercock seeker guidance system thus utilized in accordance with the classical pursuit guidance law was very effective. However, against targets moving even at 20 to 30 miles per hour, or stationary targets in the presence of significant crosswind, pursuit guidance as implemented by the Texas Instrument System was ineffective and will always result in a miss. For instance, FIG. 2 illustrates the situation where the missile 14 has a practical 4*g* acceleration limit; that is to say the missile is a low performance vehicle having a maximum lateral 4*g* acceleration capability. This Figure illustrates that for high velocity surface targets, pursuit guidance faced with this practical acceleration limit may cause the miss to be as high as 60 ft.

To remove both the miss caused by the unrealistic acceleration requirements of the classical pursuit guidance law and the miss caused by the crosswind and flow bias effects intrinsic to the velocity-vane seeker implementation was the practical situation the inventor faced. This is a significant problem that can be and is effectively solved by the method and aparatus disclosed and claimed in this patent application, when implemented in accordance with the new modified pursuit guidance law.

Figure 5:
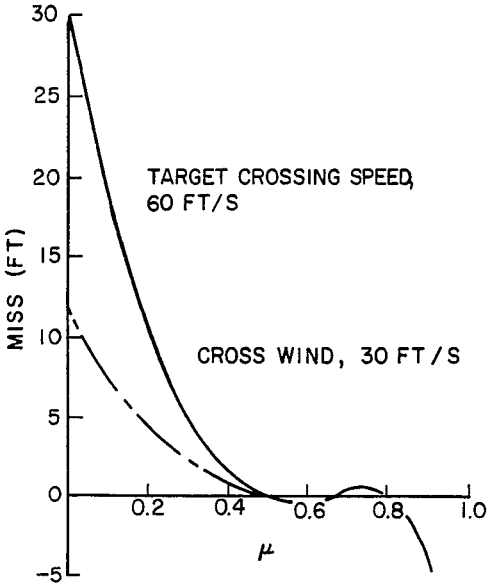
FIG. 5 is a two demensional representation of the new guidance law with a graphic illustration of the miss at intercept plotted against the guidance gain $\mu$.
Figure 5:
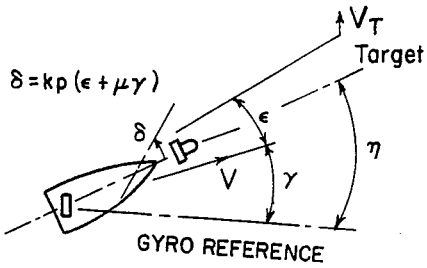

The modified pursuit guidance law of this invention is to be expressed as canard deflecton delta ($\delta$)=Kp ($\xi$+( ($\mu$) ($\gamma$)), where Kp and $\mu$ are suitable constants; $\gamma$, as shown in FIG. 5 is the flight heading angle, and epsilon ($\xi$) the pursuit angle. Implementation of this law using a modified Paveway pursuit guidance seeker is particularly simple. The old pursuit guidance using the velocity-vane seeker is employed following target acquisition until the error or pursuit angle is about 1°. The missile canards are then nulled and the missile weathercocks rapidly into coincidence with its velocity vector V. At this time a two-degree-of-freedom roll-free reference gyroscope is uncaged. The gyroscope combined with potentiometers mounted in the seeker on the hooks joint pivots provides the subsequent flight heading angle gamma ($\gamma$) of the missile.

Figure 4:
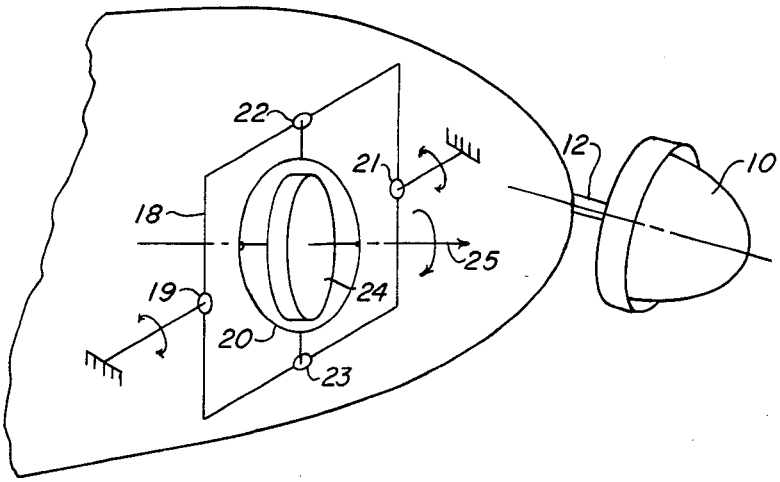
FIG. 4 is a partially cut away view of one realization of the inertial measuring device of the instant inventive guidance system.

FIG. 4 illustrates in a partially cutaway view the detailed arrangement of the gyroscope and the supporting gimbals. The outer gimbal 18 is fixed to the frame of the missile and is pivotable around pivot points 19 and 21. Inner gimbal 20 is attached to the outer gimbal through the pivot points 22 and 23. The gyro 24 is free to spin about the axis 25. Because of the pivoted mountings the gyro spin axis thus defines a spacially or inertially fixed reference vector. That is, the gyro spin axis 25 remains as a constant line and it should be considered a constant line of reference that ultimately allows the measurment of the angle gamma ($\gamma$) best shown in FIG. 5 to be described and explained in more detail hereafter.

In FIG. 5 the combination apparatus of this invention is disclosed. This also illustrates the prior art device, namely the weathercock seeker 10 (FIG. 1). Because the gyro spin axis 25 (FIG. 4) remains inertially fixed in space, it defines an angle relative to the changing logitudinal axis of the missile. The symmetry axis of the velocity-vane seeker always lies parallel to the missile velocity vector V, and hence by means of potentiometers mounted on the hooks joint pivots, the missile angle of attack can be measured. The angle eta ($\eta$) measured by the gyroscope is combined with the angle of attack alpha ($\alpha$) measured by the seeker to give the flight path angle shown in FIG. 5 as gamma ($\gamma$). It is one object of this invention to measure the angle gamma ($\gamma$) and to transmit the measurement, that may be expressed as a electrical signal to a servomechanism that controls the canards.

In FIG. 5 the target is illustrated with velocity $V_T$ and the angle between the velocity vector V and the target is illustrated as epsilon ($\xi$). The angle epsilon ($\xi$) is commonly designated in the art as the pursuit, or equivalently, the look angle.

This angle is used in a special relationship with angle gamma ($\gamma$) to implement the guidance law.

Figure 6:
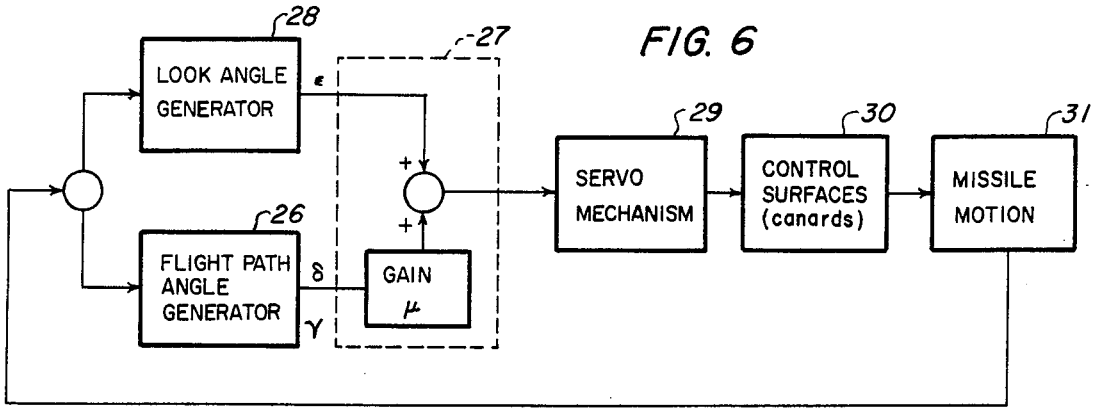
FIG. 6 is block diagram illustration of the relationship of missile motion to guidance angles.

In FIG. 6 the angle gamma ($\gamma$) is measured by a flight path angle generator 26 which may be both a gyroscope mounted to the missile airframe and potentiometers mounted on the hooks joint pivots of the weathercock stablized seeker, the resulting electrical signal may be fed sequentially to an analog or digital computer 27. the computer 27 is designed to multiply this signal with a gain mu ($\mu$), add the product to the electrical signal coming from the pursuit angle generator 28, linearly scale this new combination and issue the resulting signal as a control input to the servomechanism 29 to deflect the canards 17 and 16 (FIG. 1), in accordance with the new guidance law.

The method of guiding the missile thus requires a measure of the angle gamma ($\gamma$) defined as the angle subtended by the spin axis of the gyro and the velocity vector V which is in turn directly parallel to the longitudinal center line of the weathercock device. The angle gamma ($\gamma$) is therefore measured electrically by electrical apparatus such as potentiometers and resolvers or other equivalent apparatus, as is well known in the art. This measurement is then translated into an analog or digital signal, fed to the analog or digital computer, which in turn produces a control signal that is then fed into a servomechanism to allow the adjustment of the canards 16 and 17 best shown in FIGS. 1 and 3 to make an automatic adjustment to the flight path of the missile so as to achieve its final destination. The performance of the new guidance law is illustrated in FIG. 5, for a crossing target having a velocity $V_T$=60 ft/sec. With gain $\mu$=0, the classical pursuit case, the miss is 30 ft. This is reduced to zero with a $\mu$ of 0.5 as shown in FIG. 5.

Many obvious modifications and embodiments of the specific invention, other than those set forth above, will readily come to mind to one skilled in the art and having the benefit of the teachings presented in the foregoing description and the accompanying drawings of the subject invention and hence it is to be understood that such modification are included within the scope of the appended claims.

We claim:

1. A missile guidance system for controlling a missile with canards to strike a target comprising:

a missile longitudinal body axis;

an inertial-space-fixed reference line;

an angle, eta ($\eta$) defined as an angle between the inertial-space-fixed reference line and the missile longitudinal body axis;

means to measure the angle eta ($\eta$)

a missile velocity-vector representing the direction of the velocity of the missile;

a missile angle of attack alpha ($\alpha$) defined as an angle between the missile velocity vector and the missile longitudinal body axis;

means for measuring the missile angle of attack ($\alpha$); a missile flight path angle gamma ($\gamma$);

means to subtract angle eta ($\eta$) and angle alpha ($\alpha$) to form the missile flight path angle gamma ($\gamma$);

a missile to target line-of-sight;

means to measure a pursuit angle epsilon ($\xi$); defined as the angle between the missile to target line-of-sight and the missile velocity vector;

means to form a weighted linear combination R of angle epsilon ($\xi$) and angle gamma ($\gamma$);

a control means that functions to automatically move the canards to direct the missile to the target according to the weighted linear combination of epsilon ($\xi$) and gamma ($\gamma$); and means to feed the weighted linear combination of epsilon ($\xi$) and gamma ($\gamma$) to the control means.

2. The missile guidance system of claim 1 where the means to measure the angle between an inertial-space-fixed reference line and the missile longitudinal body axis is a two-degree-of-freedom roll-free reference gyroscope.

3. The missile guidance system of claim 1 where the means of measuring the missile angle of attack is by electrical potentionmeters attached to a hooks joint pivot means on a velocity-vane or weathercock stablized seeker.

4. The missile guidance system of claim 1 where the means of combining the angle between the inertial-space-fixed reference line and the missile longitudinal body axis with the missile angle of attack is computer means.

5. The missile guidance system of claim 1 where the means to form the weighted linear combination of the pursuit and flight path angles is computer means.

6. The missile guidance system of claim 1 wherein a means to form a control input to the control means is a computer means.

7. The missile guidance system of claim 1 where the means to move the canards is a servomechanism.

8. The missile guidance system of claim 1 where the means to measure the pursuit angle is an infrared detector mounted in a velocity-vane or weathercock stabilized seeker.

9. A missle guidance system as described in claim 1 wherein said means to form a weighted linear combination of epsilon ($\xi$) and gamma ($\gamma$) includes means for weighting in accordance with the following equation: $R=k_p(\xi+\mu\gamma)$, where $\mu$ and $k_p$ are constants.

10. A missle guidance system as described in claim 5 wherein said means to form a weighted linear combination of epsilon ($\xi$) and gamma ($\gamma$) includes means for weighting in accordance with the following equation: $R=k_p(\xi+\mu\gamma)$, where $\mu$ and $k_p$ are constants.

* * * * *